US008122937B2

(12) United States Patent
Eastman

(10) Patent No.: US 8,122,937 B2
(45) Date of Patent: Feb. 28, 2012

(54) METHOD OF FORMING TEXTURED CASTING ROLLS WITH DIAMOND ENGRAVING

(75) Inventor: Mark Eastman, Paragould, AR (US)

(73) Assignee: Nucor Corporation, Charlotte, NC (US)

( * ) Notice: Subject to any disclaimer, the term of this patent is extended or adjusted under 35 U.S.C. 154(b) by 256 days.

(21) Appl. No.: 12/326,489

(22) Filed: Dec. 2, 2008

(65) Prior Publication Data

US 2009/0145567 A1 Jun. 11, 2009

Related U.S. Application Data

(63) Continuation of application No. PCT/AU2008/001503, filed on Oct. 10, 2008.

(60) Provisional application No. 60/979,699, filed on Oct. 12, 2007.

(51) Int. Cl.
*B22D 11/06* (2006.01)

(52) U.S. Cl. ..... 164/428; 164/6

(58) Field of Classification Search ..... 164/480, 164/428, 442, 448, 6
See application file for complete search history.

(56) References Cited

U.S. PATENT DOCUMENTS

| | | | | |
|---|---|---|---|---|
| 3,345,738 | A | | 10/1967 | Mizikar et al. |
| 3,844,336 | A | | 10/1974 | Anderson |
| 3,937,270 | A | | 2/1976 | Hazelett et al. |
| 3,939,900 | A | | 2/1976 | Polk |
| 3,964,963 | A | | 6/1976 | Anderson |
| 4,002,197 | A | | 1/1977 | Hazelett |
| 4,082,101 | A | | 4/1978 | Hazelett et al. |
| 4,212,343 | A | | 7/1980 | Narasimhan |
| 4,250,950 | A | | 2/1981 | Buxmann et al. |
| 4,332,848 | A | | 6/1982 | Narasimhan |
| 4,537,810 | A | | 8/1985 | Held |
| 4,552,199 | A | | 11/1985 | Onoyama et al. |
| 4,587,895 | A | | 5/1986 | Blauhut |
| 4,612,584 | A | | 9/1986 | George et al. |
| 4,658,885 | A | | 4/1987 | Maringer |
| 4,688,623 | A | | 8/1987 | Wakefield et al. |
| 4,703,791 | A | | 11/1987 | Sakaguchi et al. |
| 4,705,095 | A | * | 11/1987 | Gaspar ..... 164/463 |
| 4,865,117 | A | | 9/1989 | Bartlett et al. |
| 4,887,662 | A | * | 12/1989 | Tanaka et al. ..... 164/427 |
| 4,903,751 | A | | 2/1990 | Hackman |

(Continued)

FOREIGN PATENT DOCUMENTS

CA 2337246 A1 2/2000

(Continued)

OTHER PUBLICATIONS

ISR_PCT/AU2008/001503, mailed Dec. 12, 2008.

(Continued)

*Primary Examiner* — Kevin P Kerns
(74) *Attorney, Agent, or Firm* — Hahn Loeser & Parks LLP

(57) ABSTRACT

A method of forming a textured casting roll may include a step of forming a plurality of contiguous rows of gravure cells on the surface of a casting roll, removing portions of the cells to leave raised portions corresponding to raised portions of the gravure cells not removed. The gravure cells may be formed by diamond engraving, and the step of removing portions of the gravure cells may be accomplished by engraving or etching.

30 Claims, 6 Drawing Sheets

U.S. PATENT DOCUMENTS

| | | | |
|---|---|---|---|
| 4,921,037 | A | 5/1990 | Bergeron et al. |
| 4,945,974 | A | 8/1990 | Honeycutt |
| 5,010,947 | A | 4/1991 | Yukumoto et al. |
| 5,018,569 | A | 5/1991 | Burau et al. |
| 5,052,471 | A | 10/1991 | Ueda |
| 5,082,046 | A | 1/1992 | Blin |
| 5,103,895 | A | 4/1992 | Furuya et al. |
| 5,117,896 | A | 6/1992 | Tavernin |
| 5,156,201 | A | 10/1992 | Blin et al. |
| 5,197,536 | A | 3/1993 | Hanneman |
| 5,227,251 | A | 7/1993 | Suichi |
| 5,286,315 | A | 2/1994 | Iwayama et al. |
| 5,368,088 | A | 11/1994 | Furuya et al. |
| 5,391,856 | A | 2/1995 | Minamida et al. |
| 5,417,772 | A | 5/1995 | Bavay et al. |
| 5,426,588 | A | 6/1995 | Walters |
| 5,467,811 | A | 11/1995 | Suehiro et al. |
| 5,497,822 | A | 3/1996 | Schenk |
| 5,520,243 | A | 5/1996 | Freeman et al. |
| 5,522,786 | A | 6/1996 | Fields et al. |
| 5,590,702 | A | 1/1997 | Schenk |
| 5,636,681 | A | 6/1997 | Sulzer et al. |
| 5,651,413 | A | 7/1997 | Williams et al. |
| 5,671,063 | A | 9/1997 | Auberry et al. |
| 5,671,800 | A | 9/1997 | Sulzer et al. |
| 5,701,948 | A | 12/1997 | Strezov et al. |
| 5,719,683 | A | 2/1998 | Yoshida |
| 5,720,336 | A | 2/1998 | Strezov |
| 5,756,131 | A | 5/1998 | Suh |
| 5,787,967 | A | 8/1998 | Vendeville et al. |
| 5,807,444 | A | 9/1998 | Paradis et al. |
| 5,831,745 | A | 11/1998 | Ogawa |
| 5,847,837 | A | 12/1998 | Ogawa |
| 5,901,777 | A | 5/1999 | Matsumura et al. |
| 5,934,359 | A | 8/1999 | Strezov |
| 5,964,277 | A | 10/1999 | Tanaka et al. |
| 5,983,980 | A | 11/1999 | Freeman et al. |
| 6,025,921 | A | 2/2000 | Beckett et al. |
| 6,048,446 | A | 4/2000 | Michaelis |
| 6,059,014 | A | 5/2000 | Strezov |
| 6,063,215 | A | 5/2000 | Harrington |
| 6,120,621 | A | 9/2000 | Jin et al. |
| 6,187,217 | B1 | 2/2001 | Arai |
| 6,310,117 | B1 | 10/2001 | Sawada et al. |
| 6,431,256 | B1 | 8/2002 | Ferretti et al. |
| 6,470,959 | B1 | 10/2002 | Desrosiers et al. |
| 6,491,089 | B1 | 12/2002 | Poirier et al. |
| 6,525,839 | B1 | 2/2003 | Beckett et al. |
| 6,575,225 | B1 | 6/2003 | Hohenbichler |
| 6,672,368 | B2 | 1/2004 | Unal |
| 6,679,313 | B2 | 1/2004 | Poirier et al. |
| 6,725,904 | B2 | 4/2004 | Desrosiers et al. |
| 6,731,405 | B2 | 5/2004 | Samworth |
| 6,739,383 | B1 | 5/2004 | Marchionni et al. |
| 6,741,369 | B1 | 5/2004 | Beisswenger |
| 6,789,602 | B2 | 9/2004 | Li et al. |
| 6,796,363 | B2 | 9/2004 | Arai et al. |
| 6,830,633 | B2 | 12/2004 | Arai et al. |
| 6,838,014 | B2 | 1/2005 | Arai et al. |
| 6,892,792 | B2 | 5/2005 | Arai et al. |
| 6,896,033 | B2 | 5/2005 | Yamamura et al. |
| 6,907,915 | B2 | 6/2005 | Hohenbichler et al. |
| 6,916,385 | B2 | 7/2005 | Arai et al. |
| 6,942,013 | B2 | 9/2005 | Strezov et al. |
| 7,059,384 | B2 | 6/2006 | Bouchard et al. |
| 7,073,565 | B2 | 7/2006 | Nikolovski et al. |
| 7,082,986 | B2 | 8/2006 | Steen |
| 7,085,018 | B1 | 8/2006 | Weidlich |
| 7,102,794 | B1 | 9/2006 | Lubcke |
| 7,125,612 | B2 | 10/2006 | Unal |
| 7,138,070 | B2 | 11/2006 | Arai et al. |
| 7,156,152 | B2 | 1/2007 | Hohenbichler |
| 7,159,641 | B2 | 1/2007 | Yamamura et al. |
| 7,281,567 | B2 | 10/2007 | Hohenbichler et al. |
| 7,328,737 | B2 | 2/2008 | Hohenbichler |
| 7,448,432 | B2 | 11/2008 | Barker et al. |
| 7,604,039 | B2 | 10/2009 | Nikolovski et al. |
| 2003/0062146 | A1 | 4/2003 | Strezov |

FOREIGN PATENT DOCUMENTS

| | | | |
|---|---|---|---|
| CA | 2302476 | A1 | 8/2000 |
| DE | 1364717 | | 5/1963 |
| EP | 0024506 | A1 | 3/1981 |
| EP | 0417318 | A1 | 3/1991 |
| EP | 0481481 | A1 | 4/1992 |
| EP | 0679114 | B1 | 11/1995 |
| EP | 0709151 | A1 | 5/1996 |
| EP | 0908255 | A1 | 4/1999 |
| EP | 0928652 | A1 | 7/1999 |
| EP | 1029617 | A2 | 8/2000 |
| EP | 1099496 | A1 | 5/2001 |
| EP | 1185387 | B1 | 12/2002 |
| EP | 1345719 | B1 | 4/2006 |
| JP | 56039156 | | 4/1981 |
| JP | 56045255 | | 4/1981 |
| JP | 58014917 | | 1/1983 |
| JP | 58029557 | | 2/1983 |
| JP | 60005852 | | 1/1985 |
| JP | 60040650 | | 3/1985 |
| JP | 60145252 | | 7/1985 |
| JP | 60257954 | | 12/1985 |
| JP | 63076740 | | 4/1988 |
| JP | 63084701 | | 4/1988 |
| JP | 64083340 | | 3/1989 |
| JP | 64083342 | | 3/1989 |
| JP | 01218743 | | 8/1989 |
| JP | 2052151 | A1 | 2/1990 |
| JP | 02052152 | | 2/1990 |
| JP | 02054718 | | 2/1990 |
| JP | 02165849 | | 6/1990 |
| JP | 02224851 | | 9/1990 |
| JP | 02224852 | | 9/1990 |
| JP | 02224853 | | 9/1990 |
| JP | 02295647 | | 12/1990 |
| JP | 02295648 | | 12/1990 |
| JP | 03066455 | | 3/1991 |
| JP | 03066456 | | 3/1991 |
| JP | 03066458 | | 3/1991 |
| JP | 03066460 | | 3/1991 |
| JP | 03110044 | | 5/1991 |
| JP | 03128149 | | 5/1991 |
| JP | 03128169 | | 5/1991 |
| JP | 03161148 | | 7/1991 |
| JP | 03180253 | | 8/1991 |
| JP | 03198951 | | 8/1991 |
| JP | 03204147 | | 9/1991 |
| JP | 04004955 | | 1/1992 |
| JP | 04041052 | | 2/1992 |
| JP | 04084649 | | 3/1992 |
| JP | 04089159 | | 3/1992 |
| JP | 04147750 | | 5/1992 |
| JP | 04158957 | | 6/1992 |
| JP | 04238654 | | 8/1992 |
| JP | 04322844 | | 11/1992 |
| JP | 04361854 | | 12/1992 |
| JP | 05007998 | | 1/1993 |
| JP | 05261487 | | 10/1993 |
| JP | 05261493 | | 10/1993 |
| JP | 05277651 | | 10/1993 |
| JP | 05285601 | | 11/1993 |
| JP | 5285602 | A1 | 11/1993 |
| JP | 05285603 | | 11/1993 |
| JP | 05318150 | | 12/1993 |
| JP | 05318151 | | 12/1993 |
| JP | 05329588 | | 12/1993 |
| JP | 05329589 | | 12/1993 |
| JP | 05329590 | | 12/1993 |
| JP | 05329667 | | 12/1993 |
| JP | 05329668 | | 12/1993 |
| JP | 06023493 | | 1/1994 |
| JP | 06031149 | | 2/1994 |
| JP | 06039501 | | 2/1994 |
| JP | 06091353 | | 4/1994 |
| JP | 6297103 | A1 | 10/1994 |
| JP | 06297110 | | 10/1994 |
| JP | 06320241 | | 11/1994 |
| JP | 06328204 | | 11/1994 |
| JP | 07001088 | | 1/1995 |

| | | | |
|---|---|---|---|
| JP | 07024924 | | 1/1995 |
| JP | 07068351 | | 3/1995 |
| JP | 07075856 | | 3/1995 |
| JP | 07096351 | | 4/1995 |
| JP | 07290192 | | 11/1995 |
| JP | 08033953 | | 2/1996 |
| JP | 08039199 | | 2/1996 |
| JP | 08150442 | | 6/1996 |
| JP | 8165523 | A1 | 6/1996 |
| JP | 8277423 | A1 | 10/1996 |
| JP | 8300107 | A1 | 11/1996 |
| JP | 08309491 | | 11/1996 |
| JP | 09103849 | | 4/1997 |
| JP | 09108790 | | 4/1997 |
| JP | 09239497 | | 9/1997 |
| JP | 09327753 | | 12/1997 |
| JP | 10202345 | | 8/1998 |
| JP | 11010288 | | 1/1999 |
| JP | 11054306 | | 2/1999 |
| JP | 11179493 | | 7/1999 |
| JP | 11267799 | | 10/1999 |
| JP | 2000077219 | A1 | 3/2000 |
| JP | 2000301295 | | 10/2000 |
| JP | 2001205398 | | 7/2001 |
| JP | 2001321895 | | 11/2001 |
| JP | 2001353559 | | 12/2001 |
| JP | 2002057016 | | 2/2002 |
| JP | 2002059246 | | 2/2002 |
| JP | 2002103064 | | 4/2002 |
| JP | 2002113557 | | 4/2002 |
| JP | 2002113559 | | 4/2002 |
| JP | 2002239766 | | 8/2002 |
| JP | 2002263803 | | 9/2002 |
| JP | 2003225742 | | 8/2003 |
| JP | 2003290883 | | 10/2003 |
| JP | 2003305548 | | 10/2003 |
| JP | 2004042128 | | 2/2004 |
| JP | 2004148406 | A1 | 5/2004 |
| JP | 2005088063 | | 4/2005 |
| JP | 2005309491 | | 4/2005 |
| JP | 2005138137 | | 6/2005 |
| JP | 2006045255 | | 2/2006 |
| JP | 2006039156 | | 9/2006 |
| KR | 20000040609 | A1 | 7/2000 |
| KR | 20010056758 | A1 | 7/2001 |
| KR | 20020016265 | A1 | 3/2002 |
| KR | 20040047085 | A1 | 6/2004 |
| WO | 8702284 | A1 | 4/1987 |
| WO | 9010515 | A1 | 9/1990 |
| WO | 93/08941 | A1 | 5/1993 |
| WO | 9308941 | A1 | 5/1993 |
| WO | WO 93/08941 | A1 * | 5/1993 |
| WO | 9513889 | A1 | 5/1995 |
| WO | 9831489 | A1 | 7/1998 |
| WO | 9855251 | A1 | 10/1998 |
| WO | 9926744 | A1 | 6/1999 |
| WO | 0007753 | | 2/2000 |
| WO | 0064612 | A1 | 11/2000 |
| WO | 02/30594 | A1 | 4/2002 |
| WO | 02053311 | A2 | 7/2002 |
| WO | 02064288 | A1 | 8/2002 |

OTHER PUBLICATIONS

WO_PCT/AU2008/001503, mailed Dec. 12, 2008.

US 7,025,897, 04/2006, Arai et al. (withdrawn).

* cited by examiner

METHOD OF FORMING TEXTURED CASTING ROLLS WITH DIAMOND ENGRAVING

This patent application claims priority to and the benefit of Patent Cooperation Treaty Application serial number PCT/AU2008/001503, filed on Oct. 10, 2008, which claims priority to and the benefit of U.S. Provisional Patent Application Ser. No. 60/979,699, filed on Oct. 12, 2007, the entirety of both of which are incorporated herein by reference.

BACKGROUND AND SUMMARY

This invention relates to the casting of steel strip.

It is known to continuously cast thin strip in a twin roll caster. In a twin roll caster, molten metal is introduced between a pair of counter-rotated horizontal casting rolls which are internally cooled so that metal shells solidify on the moving casting roll surfaces, and are brought together at the nip between the casting rolls to produce a cast strip product delivered downwardly from the nip between the rolls. The term "nip" is used herein to refer to the general region at which the rolls are closest together. The molten metal may be poured from a ladle into a smaller vessel or series of vessels, from which the molten metal flows through a metal delivery nozzle located above the nip, to form a casting pool of molten metal supported on the casting surfaces above the nip and extending along the length of the nip. This casting pool is usually confined between side plates or dams held in sliding engagement with end surfaces of the casting rolls so as to restrict the two ends of the casting pool against outflow.

Although twin roll casting with textured casting surfaces has been used with some success for non-ferrous metals which solidify rapidly on cooling (See e.g., U.S. Pat. No. 4,250,950), there have been problems in applying the technique to the casting of ferrous metals. One particular problem has been the achievement of sufficiently rapid and even cooling of metal over the casting surfaces of the rolls. In particular it has proved difficult to obtain sufficiently high cooling rates for solidification onto casting rolls with smooth casting surfaces. It has been proposed to use casting rolls having casting surfaces deliberately textured by regular patterns or random distributions of projections or depressions to control heat transfer and in turn control the heat flux achieved at the casting surfaces during solidification.

For example, our U.S. Pat. No. 5,701,948 discloses a casting roll having textured casting surfaces formed with a series of parallel groove and ridge formations. The depth of the texture from ridge peak to groove root may be in the range 5 to 60 micrometers (μm) and the pitch of the texture should be in the range 100 to 250 μm. The depth of the texture may be in the range 15 to 25 μm and the pitch may be between 150 and 200 μm. In casting thin strip in a twin roll caster, the casting surfaces of the casting rolls with such groove-ridge texture of essentially constant depth and pitch may extend circumferentially around the casting roll. The texture in U.S. Pat. No. 5,701,948 is machined in successive separate annular grooves at regularly spacing along the length of the roll, or in helical grooves machined in the casting surface in the manner of a single start or a multi-start thread. This texture produces enhanced heat flux during metal solidification in order to achieve both high heat flux values and a fine microstructure in the cast steel strip. Although rolls with the texture disclosed in U.S. Pat. No. 5,701,948 have enabled achievement of high solidification rates in the casting of ferrous metal strip, the casting rolls have been found to exhibit a marked sensitivity to casting conditions, which need be closely controlled to avoid two general kinds of strip defects known as "crocodile-skin" and "chatter" defects. It also has been necessary to control sulfur additions to the melt to control crocodile-skin defects in the strip, and to operate the caster within a narrow range of casting speeds to avoid chatter defects.

The crocodile-skin defect occurs when δ and γ iron phases solidify simultaneously in shells on the casting surfaces of the rolls in a twin roll caster, under circumstances in which there are variations in heat flux through the solidifying shells. The δ and γ iron phases have differing hot strength characteristics and the heat flux variations then produce localized distortions in the solidifying shells, which result in the crocodile-skin defects in the surfaces of the resulting strip.

Chatter defects are initiated at the meniscus level of the casting pool where initial metal solidification occurs. One form of chatter defect, called "low speed chatter," is produced at low casting speeds due to premature freezing of the metal high up on the casting rolls so as to produce a weak shell which subsequently deforms as it is drawn further into the casting pool. The other form of chatter defect, called "high speed chatter," occurs at higher casting speeds when the shell starts forming further down the casting roll so that there is liquid above the forming shell. This liquid above the forming shell, from the meniscus region, cannot keep up with the moving roll surface, resulting in slippage between the liquid and the roll in the upper part of the casting pool, thus giving rise to high speed chatter defects appearing as transverse deformation bands across the strip.

To address chatter, U.S. Pat. No. 6,942,013 discloses a random texture imparted to a casting roll surface by grit blasting with hard particulate materials such as alumina, silica, or silicon carbide having a particle size of the order of 0.7 to 1.4 mm. For example, a copper roll surface may be grit blasted in this way to impose a desired texture and the textured surface protected with a thin chrome coating of the order of 50 μm thickness. Alternatively, as disclosed in U.S. Pat. No. 7,073,565, the textured casting surfaces of the casting rolls may be formed by a random height distribution of discrete projections typically at least 10 μm in height, where the molten steel used for casting has a manganese content of at least 0.55% by weight and a silicon content in the range of 0.1 to 0.35% by weight. In any case, it is possible to apply a textured surface directly to a nickel substrate with no additional protective coating. A random texture may be achieved by forming a coating by chemical deposition or electrodeposition. Suitable materials include the alloy of nickel, chromium and molybdenum available commercially under the trade name "HASTALLOY C," and the alloy of nickel, molybdenum and cobalt available commercially under the trade name "T800."

We have found an improved method of texturing casting rolls providing a substantially regular pattern of raised portions on the casting surface. A method of making textured casting rolls is disclosed comprising the steps of:

(a) forming a plurality of contiguous rows of gravure cells on a casting surface of a casting roll; and (b) removing portions of the cells to leave raised portions corresponding to raised portions of the gravure cells not removed.

Though this is not necessary, the gravure cells may be substantially uniform in size. A majority of the raised portions may have a surface area of between 40 and 40,000 $\mu m^2$, or between 14,000 and 20,000 $\mu m^2$, or between 900 and 3600 $\mu m^2$. The contiguous rows of gravure cells formed on the casting roll surface may be between 75 and 250 rows per inch, and may be skewed to the axis of the roll. The rows may be skewed between 5° and 45°.

The steps of forming the gravure cells and of removal of portions of the gravure cells may be done by diamond engraving or by laser, and the removal of the portions of the gravure cells may be done by advancing the starting point in a second pass by a fraction of the width of the gravure cell formed in making the gravure cells. The starting point of the second pass may be advanced between ¼ and ¾ of the width of the gravure cells. Optionally, the step of removing portions of the gravure cells may be done by etching.

The step of forming the gravure cells may be done by diamond engraving, and the step of removal of portions of the gravure cells may be done by etching. The steps of removing the portions of the gravure cells may be done by:

(i) masking the portions not to be etched with a resist, and (ii) etching the unmasked portions.

In another embodiment the step of forming the gravure cells may be done by diamond engraving, and the step of removal of portions of the gravure cells may be done by shot blasting.

Where the steps of forming the gravure cells, and the removal of the portions of the gravure cells may also be done by laser. However, in other embodiments where the steps of forming the gravure cells is done by laser, and the step of removal of portions of the gravure cells may be done by forming a resist pattern with a laser and then etching to remove portions of the gravure cells not covered by the resist pattern.

Also disclosed is a textured roll made by the above described method.

DETAILED DESCRIPTION OF THE DRAWINGS

Figure 1:
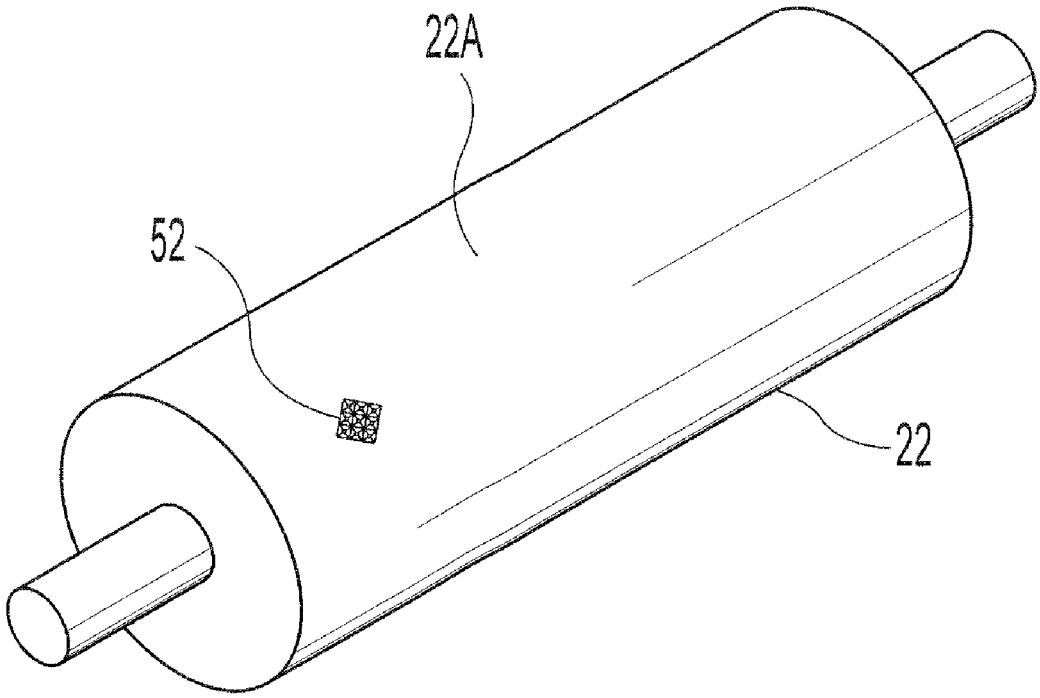
FIG. 1 is a perspective view of a textured casting roll of the present disclosure.

Referring now to FIG. 1, a casting roll 22 has a textured casting surface 22A and may be provided in a twin roll caster (not shown) for casting molten metal into cast strip. From preliminary testing, the casting rolls 22 with textured roll surfaces 22A described formed of a substantially regular texture pattern are likely to be less prone to generation of chatter and crocodile skin defects.

Figure 3:
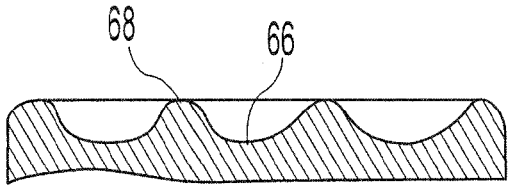
FIG. 3 is a partial section view through the gravure cells in FIG. 2 through the section 3-3.
Figure 4:
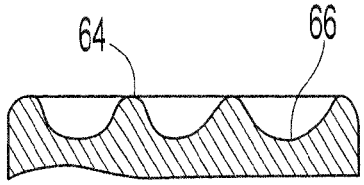
FIG. 4 is a partial section view through the gravure cells in FIG. 2 through the section 4-4.
Figure 5:
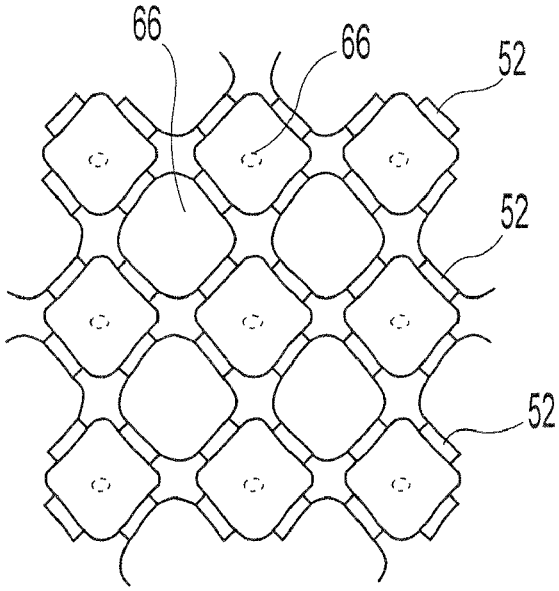
FIG. 5 is a diagrammatical plan view of a first engraved pattern of raised portions of the present disclosure.

The texture on the textured casting surface 22A may have a substantially regular pattern of raised portions 52, as shown in FIGS. 3-5. The raised portions 52 may be shapes having a surface area between 40 and 40,000 square micrometers ($\mu m^2$). The raised portions 52 may have elevations of between 20 and 100 μm from the lowest point between most raised portions. The raised portions 52 may have a surface area of between 14,000 and 20,000 $\mu m^2$ or between 900 and 3600 $\mu m^2$, and the raised portions 52 may have elevations of between 40 and 60 μm from the lowest point between most raised portions The upper surfaces of the raised portions 52 form the casting surface supporting the shells of the molten metal on the casting roll 22, while the ferrostatic pressure of the molten metal may not press the metal onto the lower surfaces between the raised portions 52.

The heat transfer from molten metal to the casting rolls 22 may be controlled by varying the number of raised portions 52 and the surface area of the raised portions. The raised portions 52 finely control the nucleation sites for formation of the shells on the casting roll surfaces. Increased heat transfer may be achieved, and in turn increased shell thickness of the casting, by controlling the surface area of the raised portions 52 and by increasing the number of raised portions 52, or decreasing the distance between raised portions 52.

Figure 2:
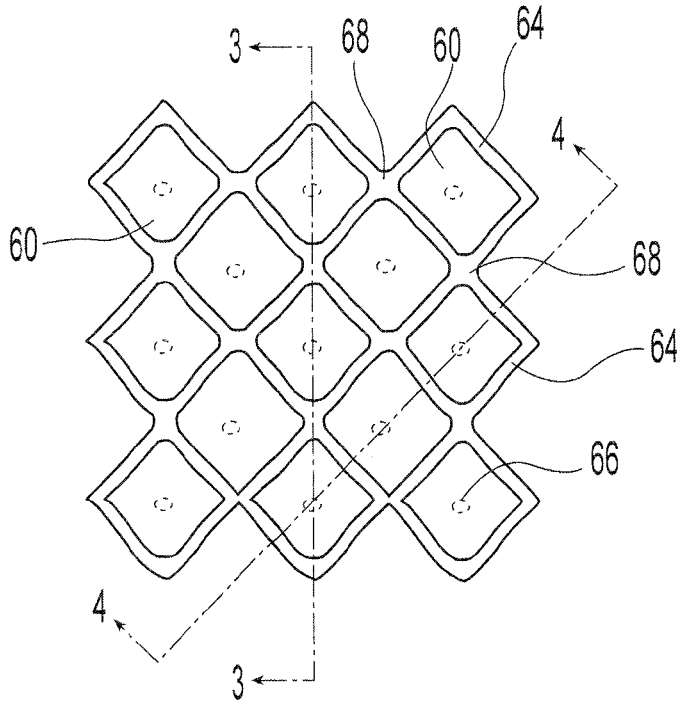
FIG. 2 is a diagrammatical plan view of a pattern of gravure cells on the surface of the casting roll of FIG. 1 as used in the method of the present disclosure.

The raised portions 52 may be formed by a method including a step of forming a plurality of contiguous rows of gravure cells 60 on the casting surface 22A. As shown in FIGS. 2 through 4, a pattern of gravure cells 60 may be formed on the surface of the casting roll 22. The formed gravure cell 60 may have walls 64 round a lower surface 66. One wall 64 may bound two or more adjacent gravure cells 60. The walls 64 of adjacent gravure cells 60 may join at intersections 68.

Gravure cells 60 normally used in the printing industry retain ink on a printing surface, but for present purposes it is not necessary that the cells be totally formed and be able to retain ink. As used in this specification and the appended claims, the gravure cells 60 may be partially formed or defectively formed.

In any case, the gravure cells may be formed in a plurality of contiguous rows on the casting surface 22A in a raster having between about 75 and 250 rows per inch. The rows of gravure cells 60 may be skewed to the axis of the casting roll. The skewed rows may be at an angle between 5° and 45° to the axis of the casting roll 22.

The number of rows of gravure cells per inch, or line density, may vary laterally and circumferentially. In an embodiment of the textured casting roll, for example, the line density of gravure cells may increase and decrease in a desired arrangement around the circumference of the roll. Alternately or in addition, the line density of gravure cells may increase and decrease in a desired arrangement laterally along the length of the roll.

The gravure cells 60 may be formed by diamond engraving, laser engraving, or another suitable technique. In gravure cell engraving, the roll being engraved may be placed on a lathe which is capable of rotating the roll under precise control. While the casting roll is rotated about its axis, an engraver forms gravure cells on the casting roll surface. The engraver may be any engraving tool suitable for forming gravure cells as here described, such as a diamond stylus or a laser.

In diamond engraving, the engraver has a diamond stylus positioned adjacent the roll, and capable of moving radially toward and away from the roll surface. The engraver may be capable of moving in an axial direction along the roll. The diamond stylus oscillates in and out of the roll surface to remove material as the diamond stylus penetrates the surface of the roll. As the roll rotates under precise control, the diamond stylus moves in and out of the surface of the casting roll at a selected frequency, generally between 3,000 Hz to 8,000 Hz to form 3000 to 8000 cells per second. As the tool penetrates the surface, the diamond makes a progressively wider and deeper cut until it oscillates out of the cell. The speed of rotation of the roll, the frequency of the diamond stylus motion, and the axial movement of the diamond stylus along the casting roll may be programmed as desired in a cutting sequence.

In this way, the gravure cells may be formed in the casting surface 22A by the engraver programmed to follow a selected cutting sequence across the casting roll 22 while the casting roll is rotated. As the engraver moves over the roll, the engraver forms the gravure cells 60 in the casting surface 22A.

To form the raised portions 52 after forming the gravure cells 60, the method may include a step of removing portions of the cells to leave the raised portions 52 corresponding to raised portions of the gravure cells 60 not removed. In this way, the textures of FIGS. 5 through 8 may be made by the steps of forming gravure cells by engraving, and then removing material to form raised portions 52 also by engraving. The raised portions 52 are generally the surface of the casting roll prepared before diamond engraving commenced.

The step of removing portions of the cells may be accomplished by a second engraving step for removing portions of the walls 64, intersections 68, or portions of both. The second engraving step may be a pass of the engraver programmed to follow a second cutting sequence across the casting roll 22. The removal of the portions of the gravure cells 60 may be done by using the same cutting sequence as the first pass but advancing the starting point in the second pass by a fraction, such as one quarter (¼) to three quarters (¾), of the width of the gravure cell formed in making the gravure cells on the first pass. For some textures, the second cutting sequence will be different than the first.

As an example, the raised portions 52 may be formed in the casting roll surface by engraving the gravure cells 60 with a diamond engraver in a cutting sequence, then making a second pass with the diamond engraver through the formed gravure cells 60 using the same cutting sequence, but offset from the first pass by one quarter (¼) to three quarters (¾) of the width of the gravure cell.

In a second example, the raised portions 52 may be formed in the casting roll surface by engraving the gravure cells 60 with a diamond engraver in a first cutting sequence, then passing the diamond engraver through the gravure cells 60 following a second cutting sequence offset from the first pass by one quarter (¼) to three quarters (¾) of the width of the gravure cell.

Figure 6:
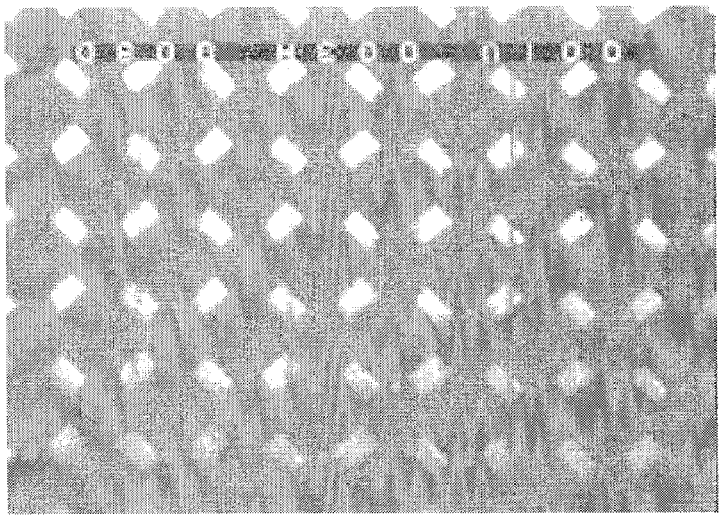
FIG. 6 is a partial view under a microscope of the first engraved pattern of raised portions of the present disclosure.

The shape and the surface area of the raised portions 52 can be varied by changing the pattern of gravure cells 60. Further, the shape of the raised portions 52 and the upper surface area may be varied by altering the path of the engraver during the second engraving step. As shown in FIGS. 5 and 6, portions of the intersections 68 may be removed leaving portions of the walls 64 to form raised portions 52. Optionally, a different second cutting path may be used to remove portions of the walls 64 and portions of the intersections 68, leaving a pattern of raised portions as shown in FIGS. 7 and 8.

In FIGS. 5 and 6, the textures include raised portions 52 of regular size and shape, and, for example, each having an upper surface about 50 μm by about 80 μm in rectangular shape. As the texture of FIGS. 5 and 6 may be made by removing portions of the intersections 68 leaving portions of the walls 64, the raised portions 52 may have a width the same as or less than the width of the walls 64 of the gravure cells 60, and oriented along the directions of the walls 64. Optionally, the texture may include raised portions 52 having different sizes, for example certain raised portions having upper surfaces about 50 μm by about 100 μm, and other raised portions having upper surfaces about 50 μm by about 50 μm as rectangular shape.

Figure 7:
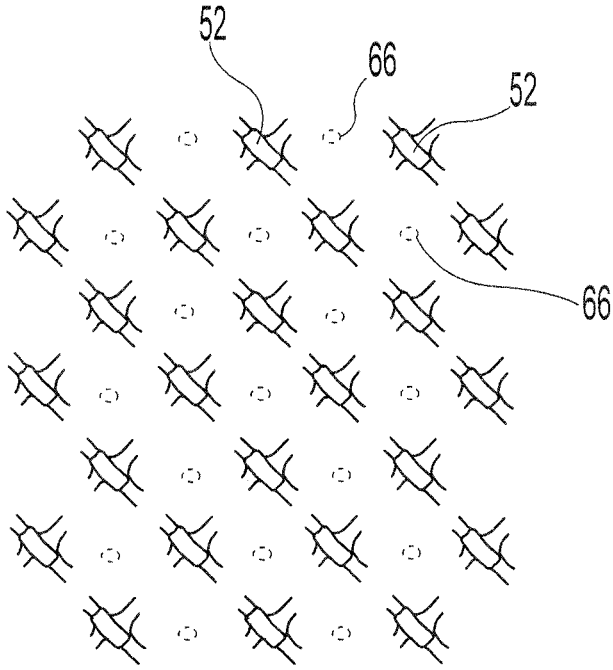
FIG. 7 is a diagrammatical plan view of a second engraved pattern of raised portions of the present disclosure.
Figure 8:
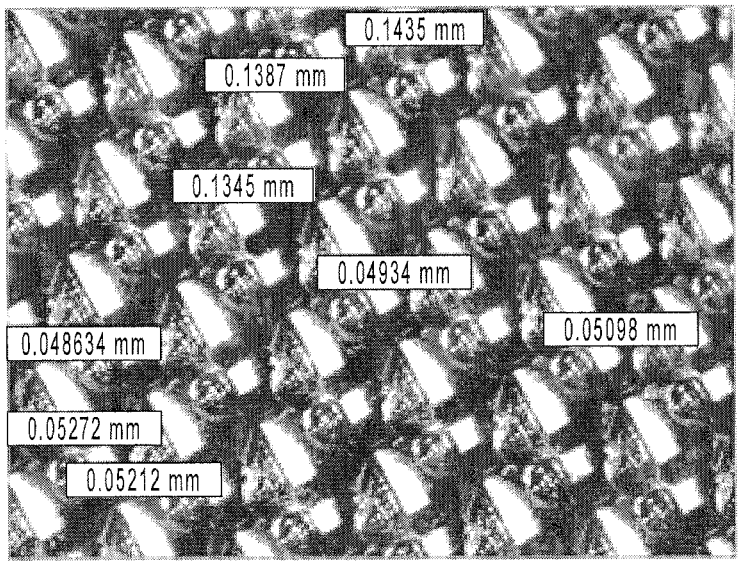
FIG. 8 is a partial view under a microscope of the second engraved pattern of raised portions of the present disclosure.

The textures of FIGS. 7 and 8 include raised portions 52 formed by removing portions of the walls 64 leaving portions of the intersections 68. In FIG. 7, the texture includes raised portions 52 of regular size and shape, and, for example, raised portions having upper surfaces about 50 μm by about 100 μm. In FIG. 8, the texture includes raised portions 52 having different sizes, for example certain raised portions having upper surfaces about 50 μm by about 100 μm, and other raised portions having upper surfaces about 50 μm by about 50 μm.

Alternatively, the step of removing portions of the gravure cells 60 may be accomplished by etching. Portions of the gravure cells 60 not to be removed may be masked with a resist. The mask may be provided to portions of the gravure cells 60 by applying a resist to the gravure cells 60 and forming a mask pattern in the resist with a laser. In an etching step, the portions of the gravure cells 60 not masked are exposed to an etching chemical for a selected duration of time. The etching process may remove portions of the walls 64, intersections 68, or portions of both leaving raised portions corresponding to the raised portions of the gravure cells not removed.

Alternatively, the step of removing portions of the gravure cells 60 may be accomplished by shot blasting. The shot blasting may remove portions of the walls 64, intersections 68, or portions of both leaving raised portions corresponding to the raised portions of the gravure cells not removed. After formation of the gravure cells, the casting roll surface may be impinged by shot blasting using about a 330 size shot. Alternately, the shot size may be a 230 size. The size of the shot may be smaller as the number of rows per inch increases.

Figure 9:
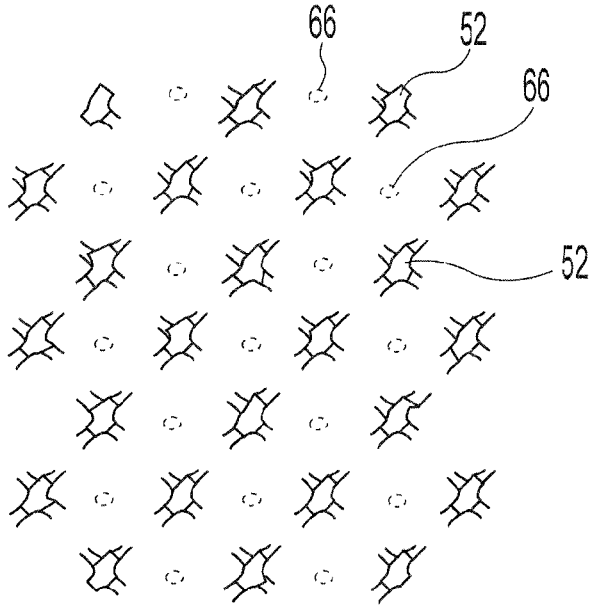
FIG. 9 is a diagrammatical plan view of an etched pattern of raised portions of the present disclosure.
Figure 10:
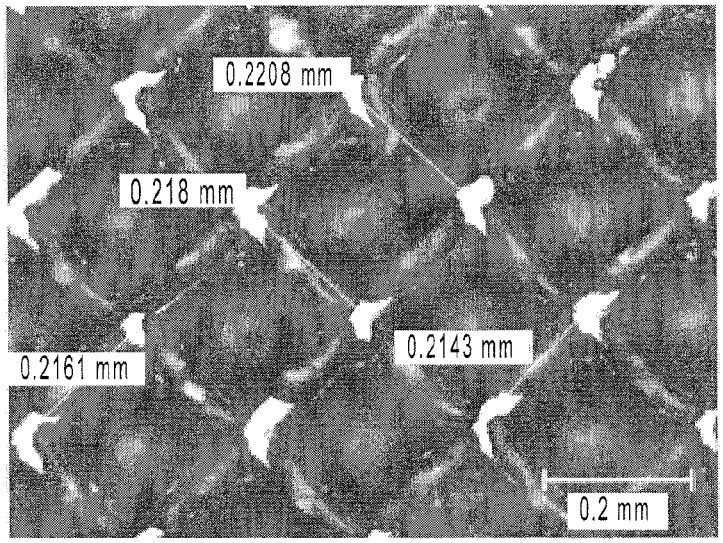
FIG. 10 is a partial view under a microscope of an etched pattern of raised portions of the present disclosure.
Figure 11:
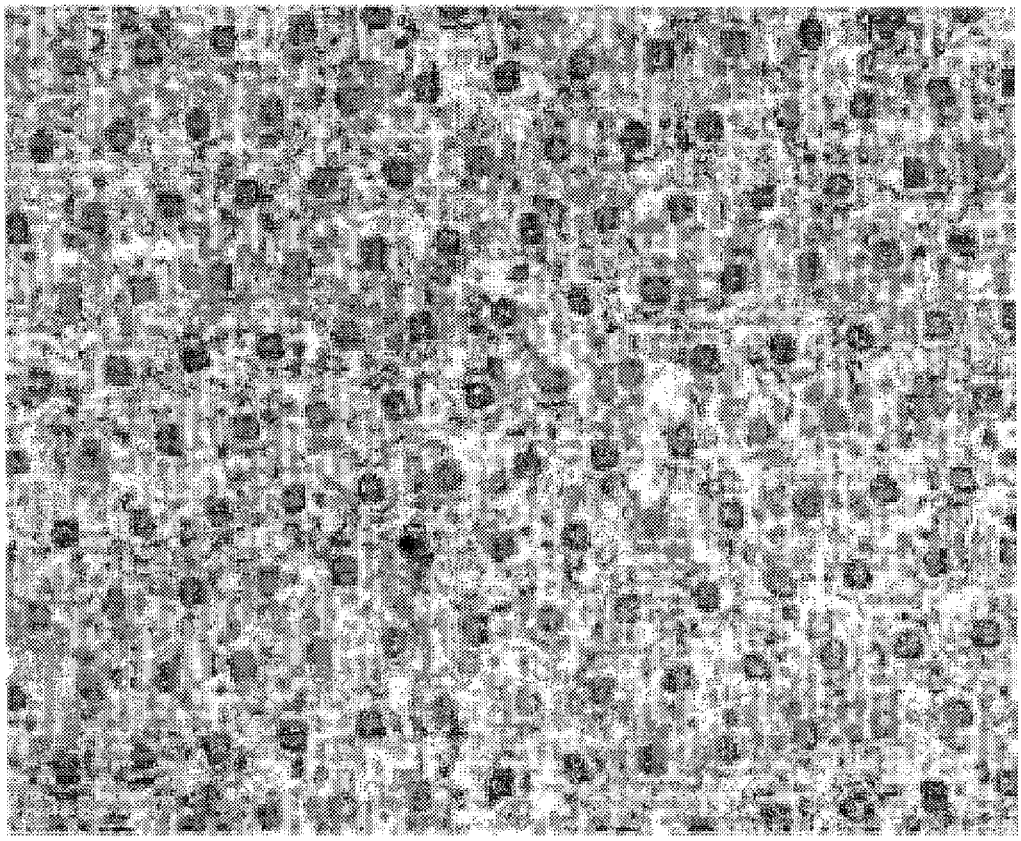
FIG. 11 is a partial view under a microscope of yet another etched pattern of raised portions of the present disclosure.

Forming the raised portions 52 from the gravure cells 60 by etching may create irregular shaped raised portions 52 as shown in FIGS. 9 through 11. For an etched texture, the surface area of the raised portions 52 may be varied by changing the pattern of gravure cells 60, such as by changing the size of the gravure cells or the number of rows on the surface. Further, raised portions 52 may have a different size and shape as a result of the masking process. The surface area may be varied by altering the mask pattern and the duration of etching. Some masking processes may result in raised portions 52 having more regular shape and size.

FIGS. 9 through 11 show textures where the step of forming gravure cells is performed by engraving, and the step of removing material to form raised portions 52 is performed by etching. Textures formed by etching may have various irregular shaped raised portions 52 depending on the pattern and size of gravure cells, the method of engraving gravure cells, and the location and shape of the mask pattern for etching.

As shown in FIG. 10, the gravure cells may be formed by diamond engraving, and the step of removing material to form raised portions 52 may be performed by chemical etching. This texture may include raised portions 52 having regular or irregular shapes, such as resembling elbow shapes shown in FIG. 10. The texture of FIG. 11 may be formed by engraving gravure cells with a laser engraver, then removing material to form raised portions 52 by chemical etching.

While this invention has been described and illustrated with reference to various embodiments, it shall be understood that such description is by way of illustration and not by way of limitation. Accordingly, the scope and content of the present invention are to be defined only by the terms of the appended claims.

What is claimed is:

1. A method of making textured casting rolls comprising the steps of:

(a) forming a plurality of contiguous rows of gravure cells on a casting surface of a casting roll; and (b) removing portions of the cells to leave raised portions corresponding to portions of the gravure cells.

2. The method of making a textured casting roll as claimed in claim 1 where the majority of the raised portions each have a surface area between 40 and 40,000 $\mu m^2$.

3. The method of making a textured casting roll as claimed in claim 1 where the majority of the raised portions each have a surface area between 14,000 and 20,000 $\mu m^2$.

4. The method of making a textured casting roll as claimed in claim 1 where the majority of the raised portions each have a surface area between 900 and 3600 $\mu m^2$.

5. The method of making a textured casting roll as claimed in claim 1 where the contiguous rows of gravure cells formed on the casting roll surface are between 75 and 250 rows per inch.

6. The method of making a textured casting roll as claimed in claim 1 where the steps of forming the gravure cells and of removal of portions of the gravure cells are done by diamond engraving.

7. The method of making a textured casting roll as claimed in claim 6 where the removal of the portions of the gravure cells is done by advancing the starting point in a second pass by a fraction of the width of the gravure cell formed in making the gravure cells.

8. The method of making a textured casting roll as claimed in claim 7 where the advancing of the starting point in a second pass is by one quarter (¼) to three quarters (¾) of the width of the gravure cell formed in making the gravure cells.

9. The method of making a textured casting roll as claimed in claim 1 where the step of forming the gravure cells is done by diamond engraving, and the step of removal of portions of the gravure cells are done by etching.

10. The method of making a textured casting roll as claimed in claim 9 where the steps of removing the portions of the gravure cells are done by:

(i) masking the portions not to be etched with a resist, and (ii) etching the unmasked portions.

11. The method of making a textured casting roll as claimed in claim 1 where the step of forming the gravure cells is done by diamond engraving, and the step of removal of portions of the gravure cells are done by shot blasting.

12. The method of making a textured casting roll as claimed in claim 1 where the steps of forming the gravure cells, and the removal of the portions of the gravure cells are done by laser.

13. The method of making a textured casting roll as claimed in claim 1 where the steps of forming the gravure cells by laser, and the step of removal of portions of the gravure cells are done by forming a resist pattern with a laser and then etching to remove portions of the gravure cells not covered by the resist pattern.

14. A method of making a textured casting roll comprising the steps of:

(a) forming a plurality of contiguous rows of gravure cells on a casting surface of a casting roll, the rows being skewed to the axis of the casting roll; and (b) removing portions of the cells to leave raised portions corresponding to portions of the gravure cells.

15. The method of making a textured casting roll as claimed in claim 14 where the rows of gravure cells are skewed to the axis of the casting roll at an angle between 5° and 45° to the axis of the casting roll.

16. A textured casting roll comprising a plurality of contiguous rows of gravure cells on a casting surface of a casting roll having portions of the cells removed to leave raised portions corresponding to portions of the gravure cells.

17. The textured casting roll as claimed in claim 16 where the majority of the raised portions each have a surface area between 40 and 10,000 $\mu m^2$.

18. The textured casting roll as claimed in claim 16 where the majority of the raised portions each have a surface area between 400 and 6400 $\mu m^2$.

19. The textured casting roll as claimed in claim 16 where the majority of the raised portions each have a surface area between 900 and 3600 $\mu m^2$.

20. The textured casting roll as claimed in claim 16 where the rows of gravure cells formed on the casting roll surface are between 75 and 250 rows per inch.

21. The textured casting roll as claimed in claim 16 where the steps of forming the gravure cells, and the removal of the portions of the gravure cells are done by diamond engraving.

22. The textured casting roll as claimed in claim 21 where the removal of the portions of the gravure cells is done by advancing the starting point in a second pass by a fraction of the width of the gravure cell formed in making the gravure cells.

23. The textured casting roll as claimed in claim 22 where the advancing of the starting point in a second pass is by one quarter (¼) to three quarters (¾) of the width of the gravure cell formed in making the gravure cells.

24. The textured casting roll as claimed in claim 16 where the steps of forming the gravure cells is done by diamond engraving, and the removal of portions of the gravure cells are done by etching.

25. The textured casting roll as claimed in claim 24 where the steps of removal of portions of the gravure cells are done by:

(i) masking the portions not to be etched with a resist, and (ii) etching the unmasked portions.

26. The textured casting roll as claimed in claim 16 where the steps of forming the gravure cells is done by diamond engraving, and the removal of portions of the gravure cells are done by shot blasting.

27. The textured casting roll as claimed in claim 16 where the steps of forming the gravure cells, and the removal of the portions of the gravure cells are done by laser.

28. The textured casting roll as claimed in claim 16 where the steps of forming the gravure cells by laser, and the step of removal of portions of the gravure cells are done by forming a resist pattern with a laser and then etching to remove portions of the gravure cells not covered by the resist pattern.

29. A textured casting roll comprising a plurality of contiguous rows of gravure cells on a casting surface of a casting roll, the rows being skewed to the axis of the casting roll having portions of the cells removed to leave raised portions corresponding to portions of the gravure cells.

30. The textured casting roll as claimed in claim 29 where the rows of gravure cells are skewed to the axis of the casting roll at an angle between 5° and 45° to the axis of the casting roll.

* * * * *